US008467694B1

(12) United States Patent
Leslie et al.

(10) Patent No.: US 8,467,694 B1
(45) Date of Patent: Jun. 18, 2013

(54) METHOD AND APPARATUS FOR CONTROLLING A FUSER OF A PRINTER

(75) Inventors: Matthew B. Leslie, Meridian, ID (US); Richard D. Taylor, Eagle, ID (US)

(73) Assignee: Marvell International Ltd., Hamilton (BM)

( * ) Notice: Subject to any disclaimer, the term of this patent is extended or adjusted under 35 U.S.C. 154(b) by 393 days.

(21) Appl. No.: 12/793,404

(22) Filed: Jun. 3, 2010

Related U.S. Application Data

(60) Provisional application No. 61/184,725, filed on Jun. 5, 2009.

(51) Int. Cl.
*G03G 15/20* (2006.01)

(52) U.S. Cl.
USPC ..... 399/67; 399/320; 219/216

(58) Field of Classification Search
USPC ..... 399/32, 67, 320; 219/216
See application file for complete search history.

(56) References Cited

U.S. PATENT DOCUMENTS 5,483,149 A * 1/1996 Barrett ..... 323/300

* cited by examiner

*Primary Examiner* — Walter L Lindsay, Jr.
*Assistant Examiner* — Barnabas Fekete

(57) ABSTRACT

In a method of generating a fuser signal for a printer, a gating signal is generated using delta-sigma modulation such that an absolute value of a deficit does not exceed a threshold. The deficit corresponds to a difference between (i) a number of positive half-cycles of an alternating current (AC) signal at which the gating signal is high and (ii) a number of negative half-cycles of the AC signal at which the gating signal is high. The gating signal is used to gate the AC signal to a fuser.

18 Claims, 5 Drawing Sheets

METHOD AND APPARATUS FOR CONTROLLING A FUSER OF A PRINTER

CROSS-REFERENCE TO RELATED APPLICATIONS

The present disclosure claims the benefit, for purposes of priority, of U.S. Provisional Patent Application No. 61/184,725, entitled "Description of a Phase-Balanced DSM for Laser Printer Fuser Heating Control," filed on Jun. 5, 2009, which is hereby incorporated by reference herein in its entirety.

FIELD OF THE DISCLOSURE

The present disclosure relates generally to controlling a fuser heating element in a laser printer and, more particularly, to using a Delta-Sigma Modulator to generate a gating signal for a fuser.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

In a laser printer, a laser beam projects onto an electrically charged, rotating drum, an image to be printed. The drum is coated with selenium, and the exposure to the laser light removes the charge from the affected areas. As the drum rotates through a supply of toner (i.e., dry ink particles), the toner is picked up by the areas of the drum that maintain a charge. The drum transfers the toner to a piece of paper by direct contact, and a fuser fuses the ink to the paper.

The fuser, the temperature of which must be accurately controlled, is heated by an AC line voltage. To control the amount of heating, the AC signal is usually gated to the fuser. When the gating signal is on, the AC waveform passes to the fuser, which generates heat. When the gating signal is off, the AC waveform does not pass to the fuser and the fuser does not heat. FIG. 1 illustrates a Triode for AC (TRIAC) 50 receiving an AC signal 52 and a gating signal 54, and outputting to a fuser 58 a gated AC signal (fuser signal) 56.

In many laser printers, the gating signal is generated using pulse width modulation (PWM). FIG. 2 illustrates a gating signal 60 generated using PWM and having a 25% duty cycle. At times 62 when the gating signal 60 is high, the TRIAC 50 passes a corresponding AC signal 64 through to the fuser. If the gating signal 60 is clocked at twice the frequency of the AC signal 64, as FIG. 2 depicts, the 25% duty cycle results in two out of every eight AC half-cycles being passed through the TRIAC 50. AC half-cycles depicted in FIG. 2 as shaded (e.g., the half-cycles 66, 68) correspond to the high periods 62 in the gating signal. FIG. 3 illustrates a pair of signals 70, 74 corresponding to the signals 60, 64 of FIG. 2. However, in FIG. 3 the duty cycle of the gating signal 70 is 50%.

A PWM device is used to generate the gating signals 60, 70. The PWM device is provided with a control signal that indicates the desired duty cycle. For example, the PWM device generates the signal 60 (FIG. 2) in response to receiving a control signal indicating a 25% duty cycle. Similarly, the PWM device generates the signal 70 (FIG. 3) in response to receiving a control signal indicating a 50% duty cycle.

SUMMARY

In one embodiment, a method of generating a fuser signal for a printer includes generating a gating signal using delta-sigma modulation such that an absolute value of a deficit does not exceed a threshold. The deficit corresponds to a difference between (i) a number of positive half-cycles of an alternating current (AC) signal at which the gating signal is high and (ii) a number of negative half-cycles of the AC signal at which the gating signal is high. The method also includes using the gating signal to gate the AC signal to a fuser.

In another embodiment, an apparatus for generating a fuser signal for a printer comprises a delta sigma modulator to generate a gating signal such that an absolute value of a deficit does not exceed a threshold. The deficit corresponds to a difference between (i) a number of positive half-cycles of an alternating current (AC) signal at which the gating signal is high and (ii) a number of negative half-cycles of the AC signal at which the gating signal is high. Additionally, the apparatus comprises a triode for AC (triac) to gate the AC signal to a fuser.

In yet another embodiment, a method includes receiving a control signal that indicates a desired percentage of time, on average, that an output signal is high, and generating the output signal based on the control signal and using delta-sigma modulation such that an absolute value of a deficit does not exceed a threshold. The deficit corresponds to a difference between (i) a number of odd clock cycles at which the output signal is high and (ii) a number of even clock cycles at which the output signal is high.

In still another embodiment, an apparatus comprises a delta sigma modulator configured to generate an output signal based on a control signal such that an absolute value of a deficit does not exceed a threshold. The deficit corresponds to a difference between (i) a number of odd clock cycles at which the output signal is high and (ii) a number of even clock cycles at which the output signal is high.

DETAILED DESCRIPTION

This document describes a novel Delta Sigma Modulator (DSM) and method of operation for use with a laser printer fuser. In light of the disclosure and teachings herein, similar methods and apparatus are suitable to be utilized in other systems as well, including, by way of example and not limitation, lighting systems, heating systems, etc. More generally, similar methods and apparatus are suitable to be utilized, by way of example and not limitation, in systems in which an AC signal is gated using a gating signal, systems in which it is desired to balance the even and odd clock cycles in which an output of a DSM goes high, etc.

Figure 1:
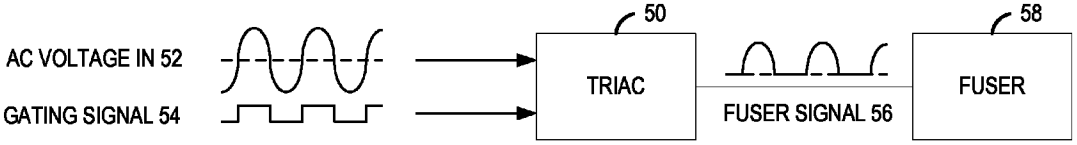
FIG. 1 PRIOR ART
FIG. 1 is a block diagram of a prior art fuser control system.
Figure 2:
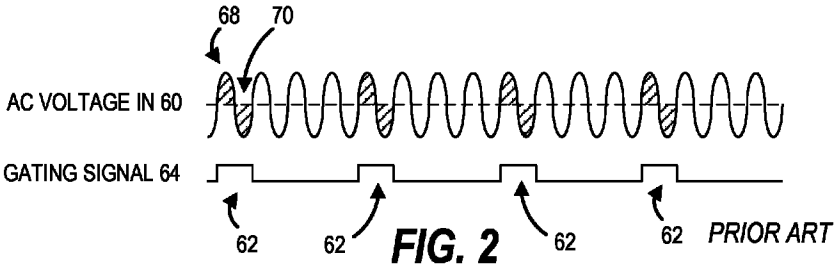
FIG. 2 PRIOR ART
FIG. 2 is a plot of a gating signal for controlling a laser printer fuser, where the gating signal is generated using pulse-width modulation (PWM)
Figure 3:
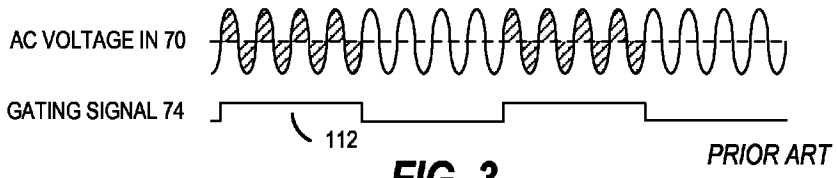
FIG. 3 PRIOR ART
FIG. 3 is a plot of a gating signal generated using pulse-width modulation (PWM)

FIG. 1 is a block diagram of an example fuser control system 100, according to an embodiment. The system 100 includes a Triode for AC (TRIAC) 104 and a fuser 108. The TRIAC 104 receives an AC input signal and a gating signal, and generates a gated AC signal (fuser signal).

The system 100 also includes a phase balanced DSM (PBDSM) 112 to generate the gating signal. The PBDSM 112 receives a clock signal and a control signal, and uses the clock signal and the control signal to generate the gating signal. In an embodiment, the clock signal operates at a frequency twice that of the AC input signal, and is synchronized to the AC input signal so that each odd clock cycle correspond to a positive half-cycle of the AC input signal and each even clock cycle correspond to a negative half-cycle of the AC input signal (or vice versa). The gating signal is phase balanced with respect to the AC input signal in that it satisfies:

$$|\text{Deficit}| \leq A \qquad \text{(Equ. 1)}$$

where Deficit=X−Y or Deficit=Y−X, X is the number of positive AC signal half-cycles in which the gating signal is high, Y is the number of negative AC signal half-cycles in which the gating signal is high, where X and Y are measured over a given number of clock cycles, and A is a threshold.

Figure 5:
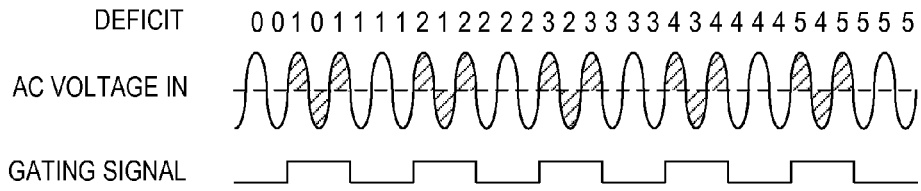
FIG. 5 is a plot of a gating signal generated using delta-sigma modulation (DSM)
Figure 6:
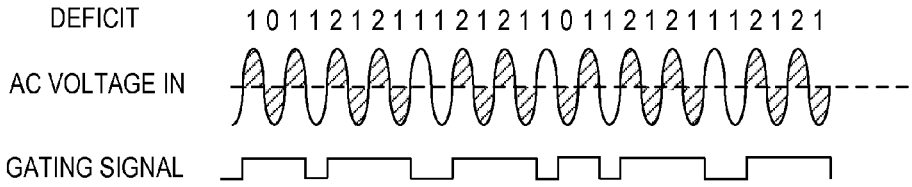
FIG. 6 is a plot of an example gating signal generated using phase-balanced DSM, according to an embodiment.

FIG. 5 is a plot of a non-phased balanced gating signal that is generated by a standard DSM. The gating signal of FIG. 5, if provided to a TRIAC, will cause 50% of the AC signal to be passed to the fuser. As illustrated in FIG. 5, the deficit of the gating signal continually increases. On the other hand, FIG. 6 is a plot of a phased balanced gating signal that is generated by the PBDSM 112, according to an embodiment. The gating signal of FIG. 6, when provided to the TRIAC 104, will cause 75% of the AC signal to be passed to the fuser 108. As can be seen in FIG. 6, the deficit never exceeds two.

Figure 4:
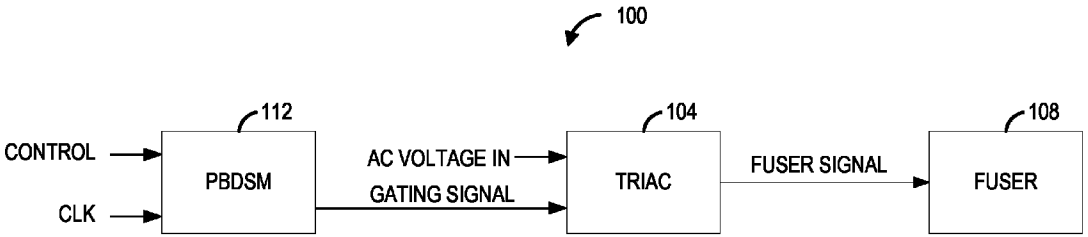
FIG. 4 is a block diagram of an example fuser control system, according to an embodiment.
Figure 7:
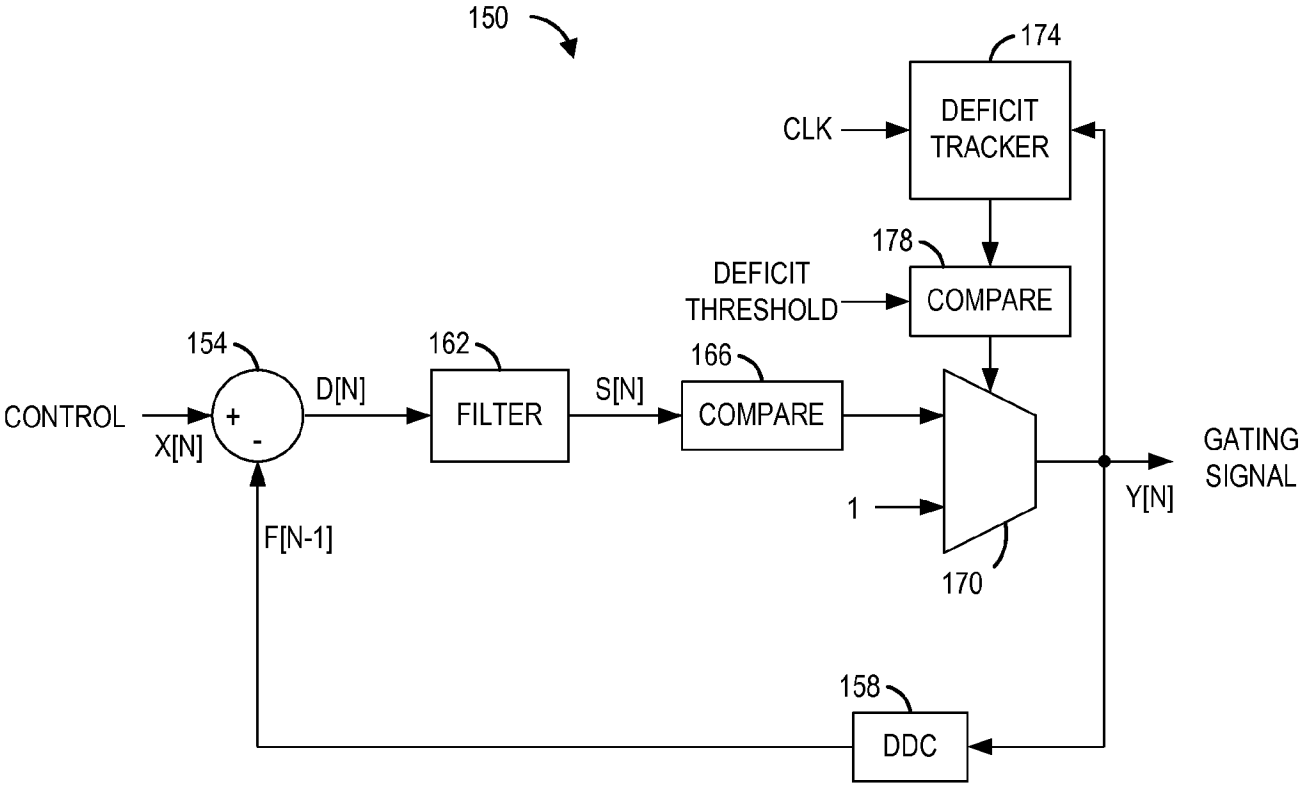
FIG. 7 is a block diagram of a phase-balanced DSM system for generating a gating signal, according to an embodiment.

FIG. 7 is a block diagram of an example PBDSM 150, according to an embodiment. The PBDSM 150 is utilized as the PBDSM 112 of FIG. 4, in one embodiment. In other embodiments, however, the PBDSM 112 of FIG. 4 is different than the PBDSM 150 of FIG. 7.

Referring now to FIG. 7, the PBDSM 150 includes a subtraction unit 154 that subtracts an output of a digital-to-digital converter (DDC) 158 from a control signal. In an embodiment, the control signal indicates a desired percentage of an AC signal that is to be passed through to a fuser. An output of the subtraction unit 154 is provided to a filter 162. In one embodiment, the filter 162 applies the following transfer function:

$$\frac{z^{-1}}{1-z^{-1}} \qquad \text{(Equ. 2)}$$

In other embodiments, the filter 162 applies other suitable transfer functions.

An output of the filter 162 is provided to a first compare unit 162. The compare unit 166 compares the output of the filter 162 to a suitable threshold and, when the output of the filter 162 meets the threshold, the compare unit 166 outputs a one. When the output of the filter 162 does not meet the threshold, the compare unit 166 outputs a zero. In one embodiment, the compare unit 166 merely outputs the most significant bit of the output of the compare unit 166.

The output of the compare unit 166 is provided to a multiplexer 170 as a first data input. A second data input of the multiplexer 170 is a logical one. The multiplexer 170 selectively sets an output of the multiplexer 170 to the output of the compare unit 166 or the logical one in response to a control input of the multiplexer 170.

The output of the multiplexer 170 corresponds to the gating signal, and is provided to an input of the DDC 158, which converts the output of the multiplexer 166. In one embodiment, the DDC 158 comprises a multiplier that multiplies the output of the multiplexer 170 by a suitable constant value.

The output of the multiplexer 170 is also provided to a deficit tracker 174 that keeps track of a deficit value. In one embodiment, the deficit tracker 174 generates a next value of the deficit based on a previous value of the deficit, the output of the multiplexer 170, and the state of the AC signal. For example, if the output of the multiplexer is 0, the next value of the deficit is set to the previous value of the deficit. If the output of the multiplexer is 1 and the AC signal is in its positive half-cycle, the next value of the deficit is incremented. If the output of the multiplexer is 1 and the AC signal is in its negative half-cycle, the next value of the deficit is decremented.

The deficit tracker 174 receives a clock having a period equal on half-period of the AC signal, in one embodiment. In one embodiment, the deficit tracker 174 keeps track of even and odd cycles of the clock and determines whether the AC signal is in its positive half-cycle or its negative half-cycle based on whether the clock is in an even cycle or an odd cycle. In another embodiment, the deficit tracker 174 includes a circuit coupled to the AC signal that determines whether the AC signal is in its positive half-cycle or its negative half-cycle.

The previous value of the deficit value is provided to a second compare unit 178. In an embodiment, if an absolute value of the previous value of the deficit value meets a deficit threshold, the compare unit 178 causes the multiplexer 166 to set the gating signal to the logical value one. If the absolute value of the previous value of the deficit value does not meet the deficit threshold, the compare unit 178 causes the multiplexer 170 to set the gating signal to the output of the first compare unit 166.

In an embodiment in which the deficit threshold is two, the previous value of the deficit value becomes two when the previous half-cycle of the AC signal was positive, and thus the current half-cycle of the AC signal is negative. By then selecting the logical one data input of multiplexer 170, the next value of the deficit value will decrement to one. Similarly, the previous value of the deficit value becomes minus two when the previous half-cycle of the AC signal was negative, and thus the current half-cycle of the AC signal is positive. By then selecting the logical one data input of multiplexer 170, the next value of the deficit value will increment to minus one.

Figure 8:
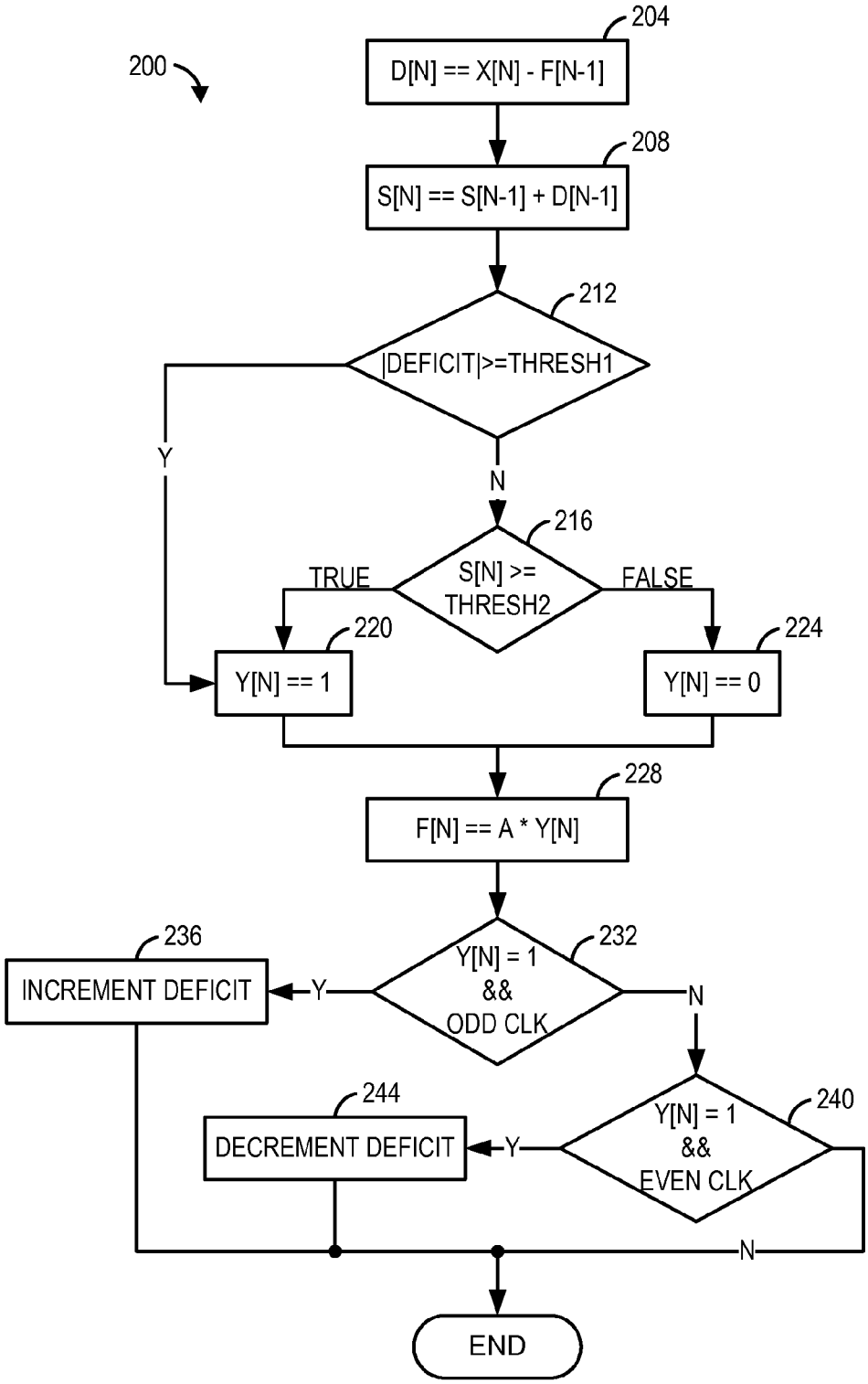
FIG. 8 is a flow diagram of a method for generating a gating signal, according to an embodiment.

FIG. 8 is a flow diagram of an example method 200 for implementing a PBDSM, according to an embodiment. The method 200 is implemented by the PBDSM 150 of FIG. 7, in one embodiment. For ease of explanation, the method 200 is described with reference to FIG. 7. In another embodiment, the method 200 is implemented by an apparatus different than the PBDSM 150 of FIG. 7. Similarly, in another embodiment, the PBDSM 150 of FIG. 7 implements a method different than the method 200 of FIG. 8.

The method 200 is implemented each clock cycle of the PBDSM 150, according to an embodiment. At block 204, the subtraction 154 calculates the difference between the control signal (X[N]), where N is a time index) and the output of the DDC 158 (F[N−1]). At block 208, the output (S[N]) of the filter 162 is calculated. At block 212, the absolute value of the Deficit is compared to a deficit threshold (THRESH1) at the compare unit 178. If the absolute value of the Deficit does not meet the deficit threshold, the flow proceeds to block 216.

At block 216, the output (S[N]) of the filter 162 is compared to a threshold (THRESH2) by the compare unit 166. If the output (S[N]) of the filter 162 meets THRESH2, the output (Y[N]) is set to one at block 220. On the other hand, if the output (S[N]) of the filter 162 does not meet THRESH2, the output (Y[N]) is set to zero at block 224 by the compare unit 166. In one embodiment, the compare unit 166 outputs either a one or a zero and the multiplexer 170 is controlled by the compare unit 178 to set the output (Y[N]) to the output of the compare unit 166.

Referring again to block 212, if it is determined that the absolute value of the Deficit meets the deficit threshold, the flow proceeds to block 220 at which the output (Y[N]) is set to one. In one embodiment, the multiplexer 170 is controlled by the compare unit 178 to set the output (Y[N]) to one. At block 228, the output (F[N]) of the DDC 158 is calculated according to A*Y[N], where A is a suitable constant.

At block 232, it is determined whether Y[N] is one and the clock is in an odd period, which corresponds to a positive half-cycle of the AC signal, in an embodiment. If Y[N] is one and the clock is in an odd period, the flow proceeds to block 236, at which the Deficit is incremented. If at block 232, however, it is determined that it is not true that Y[N] is one and the clock is in an odd period, the flow proceeds to block 240. At block 240, it is determined whether Y[N] is one and the clock is in an even period, which corresponds to a negative half-cycle of the AC signal, in an embodiment. If Y[N] is one and the clock is in an even period, the flow proceeds to block 244, at which the Deficit is decremented. Thus, if Y[N] is zero, the Deficit remains unchanged.

At least some of the various blocks, operations, and techniques described above may be implemented utilizing hardware, a processor executing firmware instructions, a processor executing software instructions, or any combination thereof. When implemented utilizing a processor executing software or firmware instructions, the software or firmware instructions may be stored in any computer readable memory such as on a magnetic disk, an optical disk, or other storage medium, in a RAM or ROM or flash memory, processor, hard disk drive, optical disk drive, tape drive, etc. Likewise, the software or firmware instructions may be delivered to a user or a system via any known or desired delivery method including, for example, on a computer readable disk or other transportable computer storage mechanism or via communication media. Communication media typically embodies computer readable instructions, data structures, program modules or other data in a modulated data signal such as a carrier wave or other transport mechanism. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, radio frequency, infrared and other wireless media. Thus, the software or firmware instructions may be delivered to a user or a system via a communication channel such as a telephone line, a DSL line, a cable television line, a fiber optics line, a wireless communication channel, the Internet, etc. (which are viewed as being the same as or interchangeable with providing such software via a transportable storage medium). The software or firmware instructions may include machine readable instructions that, when executed by the processor, cause the processor to perform various acts.

When implemented in hardware, the hardware may comprise one or more of discrete components, an integrated circuit, an application-specific integrated circuit (ASIC), a field-programmable gate array (FPGA), etc.

While the present invention has been described with reference to specific examples, which are intended to be illustrative only and not to be limiting of the invention, it will be apparent to those of ordinary skill in the art that changes, additions and/or deletions may be made to the disclosed embodiments without departing from the spirit and scope of the invention.

What is claimed is:

1. A method of generating a fuser signal for a printer, the method comprising:

generating a gating signal using delta-sigma modulation such that an absolute value of a deficit does not exceed a threshold, wherein the deficit corresponds to a difference between (i) a number of positive half-cycles of an alternating current (AC) signal at which the gating signal is high and (ii) a number of negative half-cycles of the AC signal at which the gating signal is high, wherein generating the gating signal using delta-sigma modulation comprises (i) calculating the deficit and (ii) comparing an absolute value of the deficit to a threshold; and using the gating signal to gate the AC signal to a fuser.

2. A method according to claim 1, wherein generating the gating signal comprises:

setting the gating signal to logical one if an absolute value of a previous value of the deficit meets the threshold.

3. A method according to claim 2, wherein generating the gating signal further comprises:

setting the gating signal to logical one in a negative half-cycle of the AC signal, wherein the previous value of the deficit corresponds to the immediately previous positive half-cycle of the AC signal.

4. A method according to claim 2, wherein generating the gating signal further comprises:

setting the gating signal to logical one in a positive half-cycle of the AC signal, wherein the previous value of the deficit corresponds to the immediately previous negative half-cycle of the AC signal.

5. A method according to claim 2, wherein setting the gating signal to logical one if the absolute value of the previous value of the deficit meets the threshold comprises:

selecting a data input of a multiplexer corresponding to logical one.

6. A method according to claim 1, wherein generating the gating signal is based on a control signal that indicates a desired percentage of the AC signal that is to be passed to the fuser.

7. A method according to claim 1, wherein using the gating signal to gate the AC signal to the fuser comprises utilizing a triode for AC (triac) to gate the AC signal to the fuser.

8. An apparatus for generating a fuser signal for a printer, the apparatus comprising:

a delta sigma modulator to generate a gating signal such that an absolute value of a deficit does not exceed a threshold, wherein the deficit corresponds to a difference between (i) a number of positive half-cycles of an alternating current (AC) signal at which the gating signal is high and (ii) a number of negative half-cycles of the AC signal at which the gating signal is high, wherein the delta sigma modulator comprises a deficit tracker to calculate the deficit and a comparator module to compare the absolute value of the deficit to the threshold; and a triode for AC (triac) to gate the AC signal to a fuser.

9. An apparatus according to claim 8, wherein the delta sigma modulator is configured to set the gating signal to logical one if an absolute value of a previous value of the deficit meets the threshold.

10. An apparatus according to claim 9, wherein the delta sigma modulator comprises a multiplexer having a logical one input;

wherein the delta sigma modulator is configured to select the logical one input of the multiplexer if the absolute value of the previous value of the deficit meets the threshold.

11. An apparatus according to claim 8, wherein the delta sigma modulator is configured to generate the gating signal based on a control signal that indicates a desired percentage of the AC signal, in time, that is to be passed to the fuser.

12. An apparatus according to claim 8, further comprising the fuser.

13. A method, comprising:

receiving a control signal that indicates a desired percentage of time, on average, that an output signal is high; and generating the output signal based on the control signal and using delta-sigma modulation such that an absolute value of a deficit does not exceed a threshold, wherein the deficit corresponds to a difference between (i) a number of odd clock cycles at which the output signal is high and (ii) a number of even clock cycles at which the output signal is high and wherein generating the output signal comprises setting the gating signal to an output of a delta-sigma modulator if an absolute value of a previous value of the deficit does not meet the threshold.

14. A method according to claim 13, wherein generating the output signal further comprises:

setting the output signal to logical one if the absolute value of the previous value of the deficit meets the threshold.

15. A method according to claim 14, wherein generating the output signal further comprises:

setting the gating signal to logical one in an even clock cycle, wherein the previous value of the deficit corresponds to the immediately previous odd clock cycle.

16. A method according to claim 14, wherein generating the output signal further comprises:

setting the gating signal to logical one in an odd clock cycle, wherein the previous value of the deficit corresponds to the immediately previous even clock cycle.

17. A method according to claim 14, wherein generating the output signal further comprises controlling a multiplexer to select the output of the delta-sigma modulator or logical one.

18. A method according to claim 13, wherein generating the output signal comprises:

incrementing the deficit when the output signal is high during an odd clock cycle; and decrementing the deficit when the output signal is high during an even clock cycle.

* * * * *